US011950744B2

(12) United States Patent
Fawaz et al.

(10) Patent No.: US 11,950,744 B2
(45) Date of Patent: Apr. 9, 2024

(54) DISHWASHER WITH STRAW CARRIER

(71) Applicant: Midea Group Co., Ltd., Foshan (CN)

(72) Inventors: Bassam Fawaz, Louisville, KY (US); Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 179 days.

(21) Appl. No.: 17/693,962

(22) Filed: Mar. 14, 2022

(65) Prior Publication Data

US 2023/0284867 A1 Sep. 14, 2023

(51) Int. Cl.
*A47L 15/16* (2006.01)
*A47L 15/50* (2006.01)

(52) U.S. Cl.
CPC ..... *A47L 15/508* (2013.01); *A47L 15/16* (2013.01); *A47L 15/505* (2013.01)

(58) Field of Classification Search
None
See application file for complete search history.

(56) References Cited

U.S. PATENT DOCUMENTS

| | | | |
|---|---|---|---|
| 7,846,269 | B2 | 12/2010 | Dunn et al. |
| 9,848,753 | B2 | 12/2017 | Chan et al. |
| 10,694,922 | B1 | 6/2020 | Audibert et al. |
| 10,814,363 | B2 | 10/2020 | Bowman |
| 10,932,647 | B1 | 3/2021 | Audibert |
| 2006/0065666 | A1 | 3/2006 | Dunn et al. |
| 2018/0168430 | A1* | 6/2018 | Wilson ..... A47L 15/507 |
| 2020/0237181 | A1 | 7/2020 | Campbell |
| 2021/0001385 | A1 | 1/2021 | Bowman |
| 2021/0045614 | A1 | 2/2021 | Ford |
| 2021/0274994 | A1 | 9/2021 | Garcia |
| 2022/0388040 | A1 | 12/2022 | Dunford |
| 2023/0284866 | A1 | 9/2023 | Fawaz et al. |

FOREIGN PATENT DOCUMENTS

| | | | |
|---|---|---|---|
| AU | 2020204169 | A1 | 1/2021 |
| DE | 202019104788 | U1 | 9/2019 |
| DE | 202019104789 | U1 | 9/2019 |
| DE | 202020000021 | U1 | 6/2020 |
| DE | 202020100262 | U1 | 4/2021 |
| EP | 4108153 | A1 | 12/2022 |

(Continued)

OTHER PUBLICATIONS

Related Applications Transmittal dated Feb. 9, 2024.

(Continued)

*Primary Examiner* — Levon J Shahinian
(74) *Attorney, Agent, or Firm* — Gray Ice Higdon

(57) ABSTRACT

A carrier for one or more straws of an appliance such as a dish washing appliance. The carrier and/or rack may be in fluid communication with one or more spray elements when in a stowed position within a dishwasher tub. The one or more carriers may route fluid from the one or more spray elements to wash an interior and/or an exterior of at least one straw. The carrier may include one or more bridges projecting inwardly towards the one or more straws defining one or more pathways for received fluid. The body of the carrier may include a lid and/or latch.

27 Claims, 8 Drawing Sheets

(56) References Cited

FOREIGN PATENT DOCUMENTS

GB 2576931 A 3/2020

OTHER PUBLICATIONS

Shahinian, Levon J., United States Patent and Trademark Office, Non-Final Office Action issued in U.S. Appl. No. 17/824,599, 27 pages, dated Jan. 19, 2024.
4RTIDES-RETAIL; Dishwasher Safe Straw Caddy, Retrieved from: https://4rtides.com/products/copy-of-dishwasher-safe-straw-caddy; Retrieved on: Feb. 9, 2024.
U.S. Appl. No. 17/824,599, filed May 25, 2022, US 2023-0284866 A1.
U.S. Appl. No. 18/192,373, filed Mar. 29, 2023.

* cited by examiner

DISHWASHER WITH STRAW CARRIER

BACKGROUND

The present embodiments relate to a carrier for one or more straws, with particular embodiments shown for a dishwasher rack of a dishwasher appliance.

Typical straws are placed in a vertical position within a silverware basket and/or a dishwasher rack. However, this practice often is inconsistent in cleaning the inside and/or outside of the one or more straws with fluid randomly being used during the wash cycle. Thus, there is a need to improve washing of one or more straws in a dishwasher appliance.

SUMMARY

In some embodiments of the invention, for example, a dish washing appliance may include a dishwasher tub. In various embodiments, the appliance may include a spray element disposed in the dishwasher tub, wherein the spray element may include one or more apertures, and the spray element may be in fluid communication with a fluid supply to direct fluid from the fluid supply into the dishwasher tub through the one or more apertures. In some embodiments, the appliance may include a carrier having an elongated body, wherein the elongated body may include a first end having one or more inlets and a second end having one or more outlets, wherein opposing ends of at least one straw may be positioned between the one or more inlets and the one or more outlets of the elongated body. In various embodiments, the carrier may be configured to receive fluid from the spray element and route the received fluid out of the one or more outlets to wash an interior of at least one straw through the opposing ends and exterior of at least one straw from the opposing ends of at least one straw that is positioned between the first end and the second end of the carrier.

In various embodiments, the carrier may include a channel, and wherein the channel of the carrier is orientated in a horizontal position. In some embodiments, the carrier may include a channel, and wherein the channel of the carrier is orientated in an angled position. In various embodiments, the one or more outlets may be at a lower elevation than the one or more inlets. In some embodiments, the carrier may be positioned within a rack and the spray element may be one or more docking stations positioned in a rear wall of the dishwasher tub, and wherein the one or more outlets of the carrier may be in downstream fluid communication with the one or more docking stations when the rack is in a stowed position. In various embodiments, the elongated body of the carrier may include an interior, wherein the interior may include a first end wall and a second end wall interconnected by an internal wall. In various embodiments, the appliance may include one or more protrusions projecting from at least one of the internal wall, the first end wall, and the second end wall to position an outer periphery of at least one straw from a remaining portion of the interior of the elongated body not containing the one or more protrusions. In some embodiments, the one or more protrusions may project in an annular pattern about a cylindrical surface of the internal wall. In various embodiments, the one or more protrusions may be elongated along one or more lengths of the elongated body of the carrier. In various embodiments, the one or more protrusions may project axially inward from at least one of the first end wall and the second end wall of the interior. In some embodiments, the one or more protrusions may be elongated along a radius of at least one of the first end wall and the second end wall of the interior. In various embodiments, the carrier may include a closed body wherein there is only fluid communication between the one or more inlets of the first end and the one or more outlets of the second end. In some embodiments, the carrier may include an open body, wherein the elongated body includes one or more secondary openings within the elongated body between the first end and the second end. In various embodiments, the elongated body may include a lid positionable between a closed position and an open position, wherein in the open position at least one straw may be inserted and/or removed and in the closed position the one or more outlets of the elongated body are in fluid communication with the one or more inlets of the elongated body. In various embodiments, the first end of the elongated body of the carrier may include a spray collector receiving the fluid from the spray element.

In some embodiments, a dish washing appliance may include a dishwasher tub having an opening defined by at least a rear wall opposite the opening. In various embodiments, the appliance may include a spray element disposed adjacent the rear wall of the dishwasher tub, wherein the spray element may include one or more apertures, and the spray element in fluid communication with a fluid supply to direct fluid from the fluid supply into the dishwasher tub through the one or more apertures. In some embodiments, the appliance may include a rack positionable between a stowed position and a deployed position different from the stowed position. In various embodiments, the appliance may include a carrier having an elongated body supported in the rack, wherein the elongated body may include a first end having one or more inlets adjacent to and in fluid communication with the spray element when the rack is in the stowed position and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of at least one straw through the opposing ends and exterior of at least one straw from the opposing ends of at least one straw that is positioned between the first end and the second end of the carrier.

In various embodiments, an interior of the elongated body may include at least one of an axial protrusion and a radial protrusion projecting inwardly from the interior towards at least one straw. In some embodiments, the carrier may be a closed body wherein there is only fluid communication between the one or more inlets of the first end and the one or more outlets of the second end. In various embodiments, the carrier may include an open body, wherein the elongated body may include one or more secondary openings within the elongated body between the first end and the second end. In some embodiments, the first end of the carrier may include a divider routing the received fluid to a plurality of channels defined by the elongated body of the carrier. In various embodiments, the spray element may be a docking station adjacent the rear wall, and the first end of the carrier fluidly engages the docking station when the rack is in the stowed position. In some embodiments, the elongated body may include a lid positionable between a closed position and an open position, wherein in the open position at least one straw may be inserted and/or removed and in the closed position the one or more outlets of the elongated body are in fluid communication with the one or more inlets of the elongated body. In various embodiments, the carrier may include one or more pin jet sprayers. In some embodiments, the elongated body includes a latch positionable between a closed position and an open position, wherein in the open position at least one straw may be inserted and/or removed and in the closed position at least one straw is secured. In various embodiments, the carrier may include a channel, and wherein the channel of the carrier is orientated in an angled position.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
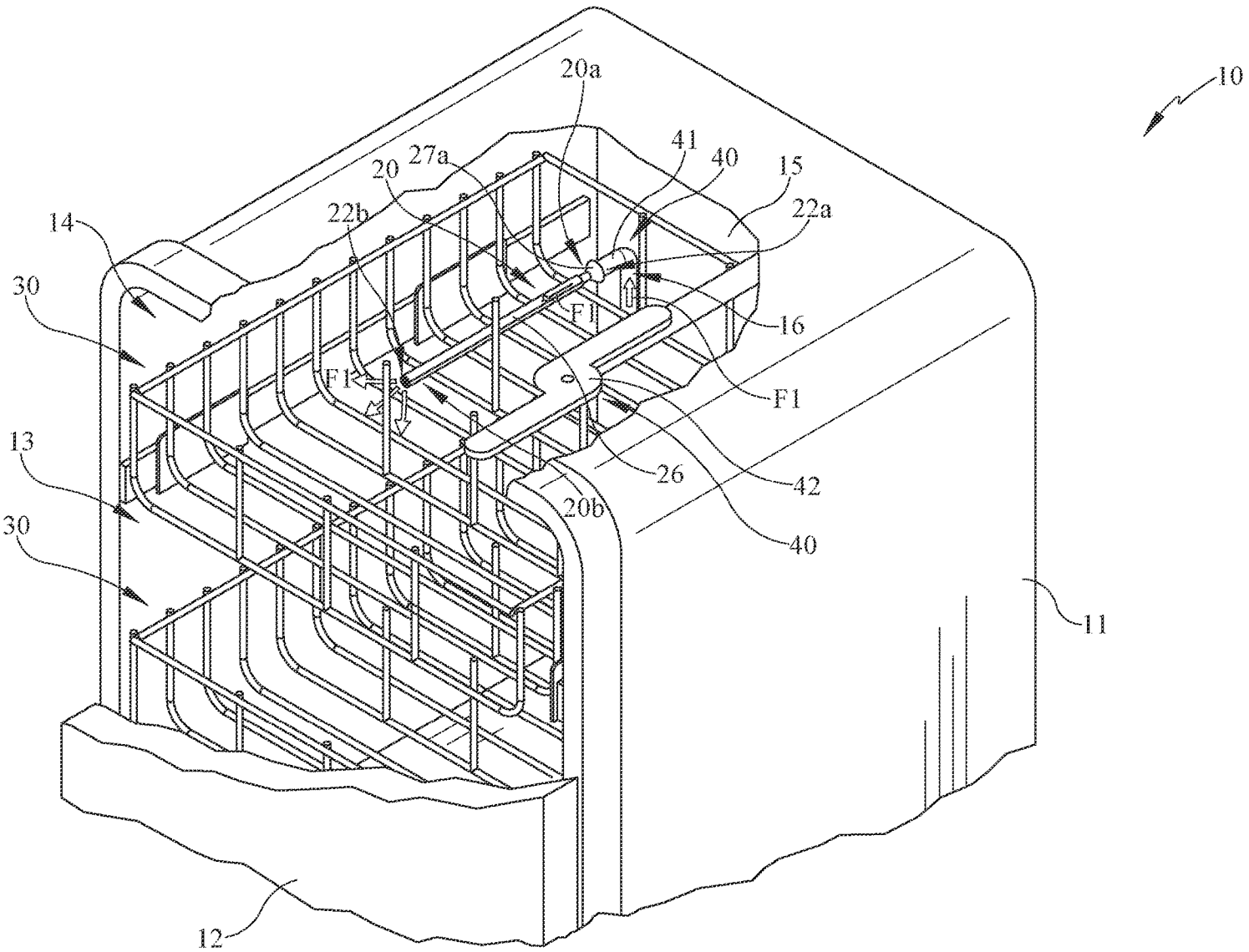
FIG. 1 is a perspective view of one embodiment of an upper/third retractable dishwasher rack illustrating a carrier for at least one straw supported by the stowed rack and in fluid communication with a spray element, with portions of the housing and dishwasher tub removed.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing or dishwasher appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments.

Embodiments for a dish washing machine 10 are shown herein for ease of understanding. For example, a front-load dish washing machine that includes a front-mounted door 12 in a cabinet or housing 11 that provides access to a horizontally-oriented dishwasher rack 30 housed within the cabinet or housing 11 may be used. More specifically, the dishwasher rack 30 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish washing appliance.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The tub 14 may be defined by at least a rear wall 15 interconnected by two opposing side walls, bottom wall, and a top wall. The door 12 may be coupled with a cabinet or housing 11 that may house the dishwasher tub 14 in some embodiments. Door 12 is generally hinged along a front or front edge of the housing 11 adjacent the opening 13 and is pivotable between the closed position illustrated in FIG. 1 and an open position (not shown). When door 12 is in the open position, dishes, utensils, pans, straws 1, one or more carriers 20, 120, 220, and/or 320, and other washable items may be inserted into and removed from the one or more dishwasher racks 30 through the opening 13 in the front of cabinet or housing 11. Control over dish washing appliance 10 by a user is generally managed through a control panel (not shown) disposed on a door 12 and implementing a user interface, and it will be appreciated that in different dish washing machine designs, control panel may include various types of input and/or output devices, including various knobs, buttons, lights, switches, textual and/or graphical displays, touch screens, etc. through which a user may configure one or more settings and start and stop the wash cycle or straw washing operation as described herein. For example, the control panel, or portions thereof, may be included with the dishwasher rack, on the interior or exterior of the door, and/or adjacent the rack within the opening of the dish washing machine. For example, in some embodiments, portions of the controls may be accessible when the door is in the open position.

Figure 5:
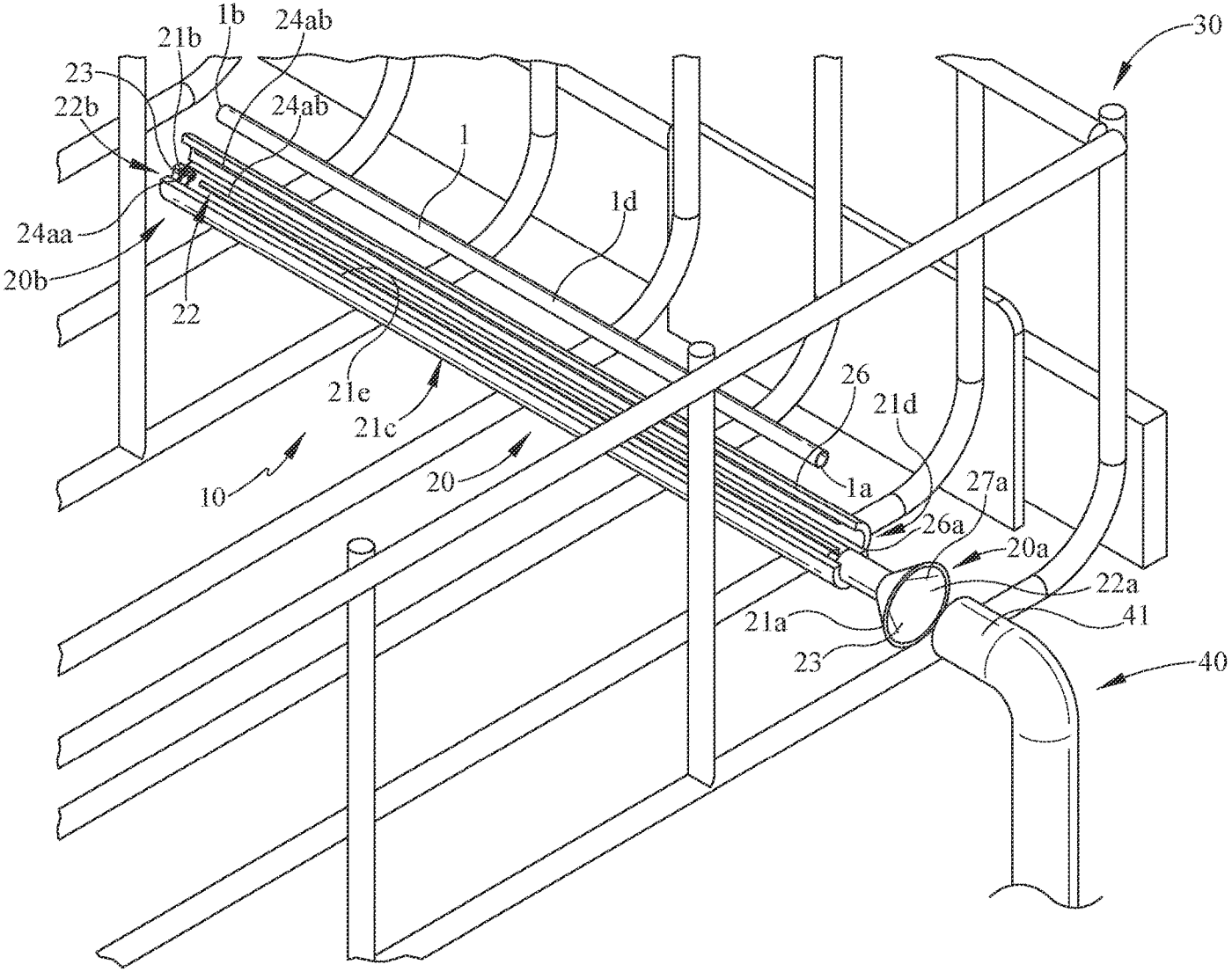
FIG. 5 is a perspective view of the embodiment of the carrier of FIG. 1 disengaged from the spray element when the rack is in the deployed position and illustrating a lid of the carrier in an open position allowing the one or more straws, exploded away from the carrier, to be inserted and/or removed.
Figure 6:
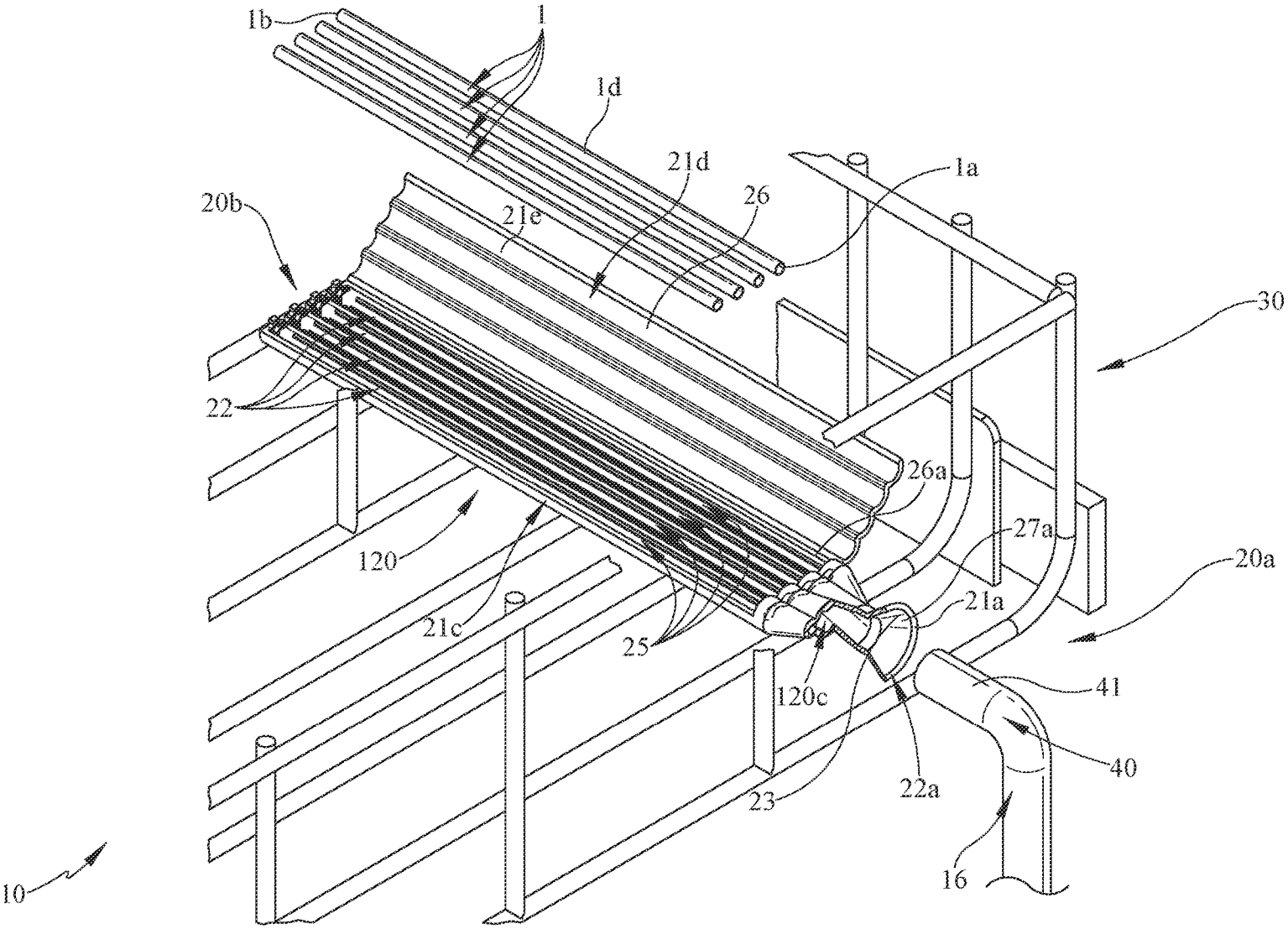
FIG. 6 is a perspective view of another embodiment of a carrier for receiving a plurality of straws, exploded away from the carrier, therein and illustrating the lid in the open position.

As shown in the figures, the one or more dishwasher racks 30, or portions thereof, may be positionable relative to the dish washing appliance 10 between a stowed or un-deployed position (FIGS. 1, 2, 4, and 8) and a deployed or different position (FIGS. 5 and 6). At least one of the stowed positions of the dishwasher rack 30 may be used when one or more of the washing or straw washing cycles is in operation. In use, the deployed position may be one or more horizontal positions different from one or more of the stowed positions. For example, one deployed position or partially opened position may be a position other than when the rack is in its fully extended position out of the dishwasher tub 14. One or more deployed positions may be a horizontal position to dry, load, and/or unload dishes, utensils, one or more straws 1, one or more carrier(s) 20, 120, 220, 320, or the like. The one or more dishwasher racks 30 and/or carrier may travel in a substantially horizontal plane. The horizontal plane may be into and/or out of the dishwasher tub 14 or cavity. Although the substantially linear movement of the dishwasher rack cycle and/or carrier may occur along the horizontal plane in a variety of heights as shown, the linear travel may be in a variety of angles in one or both the directions into or out of a position.

As illustrated in the figures, one or more straw carriers or carriers 20, 120, 220, 320 may be used to receive or temporarily retain one or more straws 1 to be washed within the dishwasher 10 and/or rack 30. The straws 1 may be a variety of shapes, sizes, constructions, and quantities. The one or more carriers 20, 120, 220, 320 may be supported within the rack 30 (e.g. upper or third rack) and deployed with the rack 30 from at least one stowed position (See FIGS. 1, 2, 4, 7, and 8) to at least one deployed position (See FIGS. 5 and 6). Alternatively, the carrier may be positioned in the tub separate from the rack. In the deployed position, one or more straws 1 may be inserted or removed from the carrier 20, 120, 220, 320. In the stowed position, the carrier 20, 120, 220, 320 may be in fluid communication with and/or used to receive fluid (e.g. first fluid F1, second fluid F2, etc.) from one or more spray elements 40 (e.g. docking station 41, spray arm 42, etc.) to wash an interior and/or exterior of the one or more straws 1 positioned/received within the carrier 20, 120, 220, 320. The carrier may fluidly engage or be configured to receive fluid from the one or more spray elements 40 when in a position (e.g. stowed/deployed rack position). A spray collector 27*a*, if used, may receive fluid from the spray element 40. A pin jet sprayer 27*b*, if used, may receive fluid from the spray element 40. Although the carrier 20, 120, 220, 320, or portions thereof, (e.g. first end 20*a*, inlet(s) 22*a*, spray collector 27*a*, pin jet sprayer 27*b*) is shown in FIGS. 1, 2, 4, 7, and 8 as fluidly engaging and/or sealing against the spray element 40 (e.g. docking station 41) when in the stowed position (e.g. rack 30 and/or carrier), it should be understood that the carrier, or portions thereof, may be spaced (e.g. one or more distances) from the spray element and still be in fluid communication with the water supply/spray element during one or more wash or straw wash cycles.

In some implementations, the carrier 20, 120, 220, 320 may temporarily receive one or more straws 1 to receive fluid directed from the one or more spray elements 40 and route the received fluid across the one or more surfaces or peripheries of the respective straw 1. The carrier 20, 120, 220, 320 may include an elongated body 21 having a first end 20*a* and an opposing second end 20*b*. The first end 20*a* of the carrier 20, 120, 220, 320 may define one or more inlets 22*a*. The second end 20*b* of the carrier 20, 120, 220, 320 may define one or more outlets 22*b*. The inlets 22*a* are in fluid communication with the outlets 22*b* along the length, or portion thereof, of the elongated body 21. The elongated body 21 defines one or more channels 22 interconnected between the inlet 22*a* and the outlet 22*b*. The straw 1, when received within the carrier 20, 120, 220, 320, is positioned within the one or more channels 22 between the first end 20*a* (e.g. inlet 22*a*) and the second end 20*b* (e.g. outlet 22*b*). The opposing ends 1*a*, 1*b* of the straw 1 are positioned between the inlet 22*a* and the outlet 22*b*, or downstream of the inlet 22*a* and upstream of the outlet 22*b*. The received fluid (e.g. first fluid F1) is directed from the inlet 22*a* past one end 1*a* of the straw 1 (e.g. first opening), progressively along the interior 1*c* and/or exterior 1*d* periphery of the straw 1, and past the other end 1*b* (e.g. second opening) to discharge from the outlet 22*b*. In some embodiments, the forced or received fluid is channeled through one or more pathways 25 along the full length of the body 21 (e.g. including the opposing ends 1*a*, 1*b*), or portions thereof, and the interior and/or exterior periphery 1*c*, 1*d* (e.g. portion, entire or full length) from the inlet 22*a* to the outlet 22*b* of the channel 22 or elongated body 21 to wash the straw 1, or portions thereof. A single straw 1 may be positioned in the channel 22 or carrier 20, 120, 220, 320. However, if more than one straw is received within the carrier, two or more straws may be placed in a single channel 22 (e.g. in series within the fluid flow) or each straw may be received in its respective channel 22 (e.g. in parallel within parallel fluid flows). For example, as shown in the one embodiment in FIG. 6, a plurality of straws 1 may be inserted into a respective channel 22 or interior 1*c* of a carrier 120 (e.g. between respective inlet and outlets of each channel). The first end 20*a* or axial/terminating end of the carrier 20, 120, 220, 320 may define at least one inlet 22*a*. The inlet 22*a* may face axially away or upstream from the body 21 (e.g. elongated cylindrical shape) towards the spray element 40, rear wall 15, and/or in the direction of travel of the rack 30. The first end 20*a* of the body may include a spray collector 27*a*. In the one embodiment shown, the spray collector 27*a*, if used, may be a conical shape or funnel tapering towards the remaining portion of the carrier body 21 or second end 20*b* away from the first end 20*a*. In some implementations, the carrier 20, 120, 220, 320 and/or application/rack may include one or more pin jet sprayers 27*b*. The first end 20*a* may include the one or more pin jet sprayers 27*b*. The pin jet sprayer 27*b*, if used, may be used downstream of one or more docking stations 41 and/or spray collectors 27*a*, if used, to force received fluid (e.g. F1) through the carrier 20, 120, 220, 320 and/or straw interior 1*c*. As shown in the one embodiment in FIG. 7, the pin jet sprayer 27*b* may be carried or supported by the rack within the carrier 220 and force fluid into the interior 1*c*/exterior 1*d* of the straw 1. The second end 20*b* or axial/terminating end of the carrier 20, 120, 220, 320 may define the outlet 22*b*. The outlet 22*b* may face axially away or downstream from the body 21 (e.g. elongated cylindrical shape) towards the door 12, opening 13, and/or in the direction of travel of the rack 30. In the one embodiment shown in the Figures, the first end 20*a* may include a single inlet 22*a* defined by a first end wall 21*a* and the downstream second end may include a plurality of outlets 22*b* divided/defined by a second end wall 21*b*, or portions thereof.

In some implementations, the elongated body 21 of the carrier 20, 120, 220, 320 may include an exterior or outer periphery 21*c* and an interior or inner periphery 21*d* to direct one or more fluid sources and/or fluids (e.g. first fluid F1, second fluid F2, etc.) at one or more time periods (e.g. same, different, overlap periods) in relation to the one or more straws 1. The interior 21*d*, or portions thereof, may define the one or more channels 22 therein. The inlet(s) 22*a* and/or the outlet(s) 22*b* may be defined as one or more apertures 23 extending from the exterior 21*c* through the interior (e.g. end walls). The interior 21*d* (e.g. channel 22) and/or exterior 21*c* may be substantially cylindrical in shape. The interior 21*d* may define one or more channels 22 to receive the one or more straws 1. The one or more channels 22 and/or straw(s)

may define a portion of the pathways 25 of fluid flow. The interior 21*d* may include or define a first end wall 21*a* (e.g. adjacent the carrier first end 20*a*) and a second end wall 21*b* (e.g. adjacent the carrier second end 20*b*) on opposing ends of the channel 22 and/or body 21. The first end wall 21*a* and second end wall 21*b* may be connected by a cylindrical or internal wall/surface 21*e* or channel 22 therebetween.

In some implementations, the carrier 20, 120, 220, 320 may be releasably or fixedly supported in one or more racks 30. The carrier 20, 120, 220, 320 may be releasably attached to the rack. This may allow for different straw carriers 20, 120, 220, 320 to be used in one or more locations within the appliance 10 and/or racks 30. For example, a user may switch out a single carrier 20 capable of holding at least one straw 1 for a carrier 120 capable of holding a plurality of straws 1. Another example, the user may change a straight straw carrier (e.g. that receives straight straws) for an angled straw carrier, not shown, (e.g. angled channel, that receives bent/angled straws). In other embodiments, the carrier 20, 120, 220, 320 may be fixed in position with the rack 30 or appliance. Further, although a single carrier 20, 120, 220, 320 is shown in the Figures within the rack 30, two or more carriers (e.g. same or different shapes, sizes, orientations, and/or positions) may be used in the rack 30 at the same time engaging one or more spray elements (e.g. same, different). One or more carriers may be positioned in a variety of orientations within the rack 30 and still be in fluid communication with one or more spray elements 40. In the one embodiment shown in FIGS. 1-7, the carrier 20, 120, 220, straw 1, channel 22, inlets 22*a*, outlets 22*b*, and/or pathways 25 are orientated in a substantially horizontal position. In the one embodiment shown in FIG. 8, the carrier 320, straw 1, channel 22, inlets 22*a*, outlets 22*b*, and/or pathways 25 may be angled/orientated (e.g. downwardly) in a substantially angled configuration/position relative to the horizontal. Although the outlet 22*b* may be at a lower elevation than the inlet 22*a* as shown in the FIG. 8, it should be understood that the inlet 22*a* may be at a lower elevation than the outlet 22*b*. For example, in one embodiment the angle θ may be greater than zero degrees to about 2 degrees. In some embodiments, the angle θ may be greater than zero degrees to about 4 degrees. However, other angles may be used. The angle θ, if used, may allow the carrier/straw/channel to drain by gravity and/or accelerate the drying process. The carrier 20, 120, 220, 320 may be positioned adjacent the rear of the rack 30. In some embodiments, the first end 20*a* and/or inlets 22*a* may be positioned adjacent the rear of the rack 30 or adjacent the rear wall 15 of the dishwasher tub 14 when in the stowed position. The second end 20*b* and/or outlets 22*b* may be positioned towards or adjacent the front of the rack 30 or adjacent the opening 13 of the dishwasher tub 14 when in the stowed position. When the carrier 20, 120, 220, 320 receives fluid from the spray element 40 in the one embodiment shown, at least some water or fluid (e.g. F1) is forced (e.g. horizontally) through the carrier 20, 120, 220, 320 from the inlet 22*a* towards the outlet 22*b* (e.g. from the rear wall 15 towards the opening 13 of the tub 14).

Figure 7:
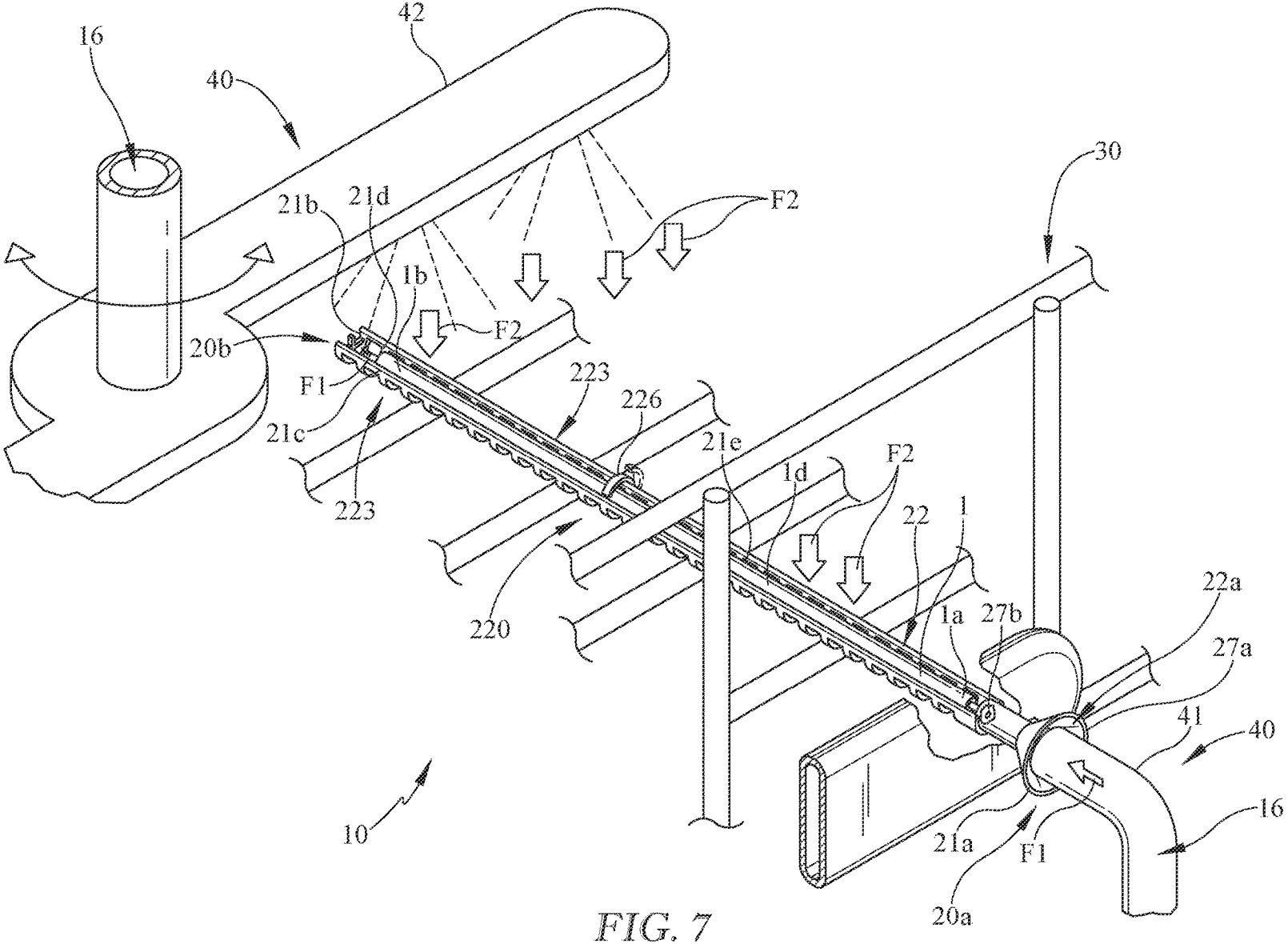
FIG. 7 is a perspective view of another embodiment of a carrier, illustrating an open body with a plurality of secondary openings between the opposing ends and/or between the inlet(s) and outlet(s) of the carrier.

In some implementations, the appliance 10 and/or carrier 20, 120, 220, 320 may include one or more spray elements 40 or apertures. The spray element(s) 40 may be in fluid communication with one or more fluid supplies 16 to direct fluid from the fluid supply 16 into the dishwasher tub 14 and/or carrier(s) through the one or more spray elements 40 (e.g. one or more apertures, pathways, devices). One embodiment of the spray element 40 includes one or more docking stations 41 in fluid communication with the one or more carriers 20, 120, 220, 320. As shown in FIGS. 1, 2, 4, and 5-8, the docking stations 41, if used, may be adjacent to or in the rear wall 15 of the dishwasher tub 14. The one or more inlets 22*a*/outlets 22*b* of the carrier 20, 120, 220, 320 are in downstream fluid communication with the one or more docking stations 41 or spray elements 40 when the rack/carrier is in the stowed position. Further, in some embodiments as shown in FIGS. 1 and 7, the spray element 40 may include one or more spray arms 42. The spray arms 42, if used, may direct water or fluid into or towards the carrier 20, 120, 220, 320 to wash one or more portions of the straw(s) 1. As shown in the one embodiment in FIG. 7, the spray arm 42 (e.g. positioned above the carrier 220) sprays or directs fluid (e.g. F2) from one or more apertures towards (e.g. downwardly) at least an exterior of the straw 1 and/or interior/exterior of the carrier (e.g. secondary openings) and/or the docking station 41 sprays or directs fluid (e.g. F1) from one or more apertures towards the interior/exterior of the straw 1 and/or interior of the carrier. Although not shown, it should be understood that the spray arm, in some embodiments, may direct fluid towards the interior of the straw alone or in combination with the exterior of the straw.

In some implementations, the carrier 20, 120, 220, 320 and/or dish washing appliance 10 may include one or more bridges, stands, or offsets 24 to create or define fluid pathways 25 around the one or more straws 1 (e.g. interior and/or exterior). In the one embodiment shown in the Figures, the one or more bridges 24 may include one or more protrusions 24*a* projecting from the internal wall 21*e*, the first end wall 21*a*, and/or second end wall 21*b* of the carrier interior 21*d*, or portions thereof. The one or more protrusions 24*a*, if used, may space/position the one or more exterior peripheries 1*d* of the straw(s) from the remaining portion of the interior 21*d* of the body 21 and/or carrier 20, 120, 220, 320. The remaining portion of the interior 21*d* (e.g. first end wall, second end wall, and/or internal wall) may not include the one or more protrusions 24*a*. The one or more protrusions 24*a* may project inwardly from the interior 21*d* of the body 21 towards the one or more straws 1, or portions thereof. One or more pathways 25 for received fluid (e.g. F1, F2) may be defined between the remaining portion, one or more protrusions 24*a*, and the interior/exterior periphery 1*c*, 1*d* of the one or more straws 1. The one or more protrusions 24*a* may taper inwardly towards the straw 1. In some implementations, the one or more protrusions 24*a* may be axial protrusions 24*aa* and/or radial protrusions 24*ab*. The one or more protrusions 24*a* (e.g. radial protrusions 24*ab*) may project (e.g. radially) from at least the internal wall 21*e* (e.g. cylindrical surface) inwardly (e.g. radially) towards the one or more straws 1. The one or more protrusions 24*a* (e.g. axial protrusion 24*aa*) may project (e.g. axially) from at least the first end wall 21*a* and/or second end wall 21*b* (e.g. adjacent the opposing ends 1*a*, 1*b* of the straw) of the interior 21*d* inwardly (e.g. axially) towards the one or more straws (e.g. one or more ends). The distal free end of the protrusion(s) may contact the exterior periphery and/or end(s) of the straw. The one or more pathways 25 may be defined between one or more adjacent protrusions 24*a*, and/or portions of the carrier/straw. The one or more protrusions 24*a* (e.g. radial, axial) may be elongated. As shown in FIGS. 2-6 and 8, the radial protrusions 24*ab*, if used, may be elongated and extend for a length L along one or more lengths or portions of the body (e.g. interior wall) of the carrier to engage one or more lengths/portions of the straw outer periphery. The elongated protrusion may extend for the entire length of the straw, may extend beyond the length and/or one or more ends 1*a*, 1*b* of the straw, or may not extend past the extent or terminal ends 1*a*, 1*b* of the straw.

Figures 2, 2A:
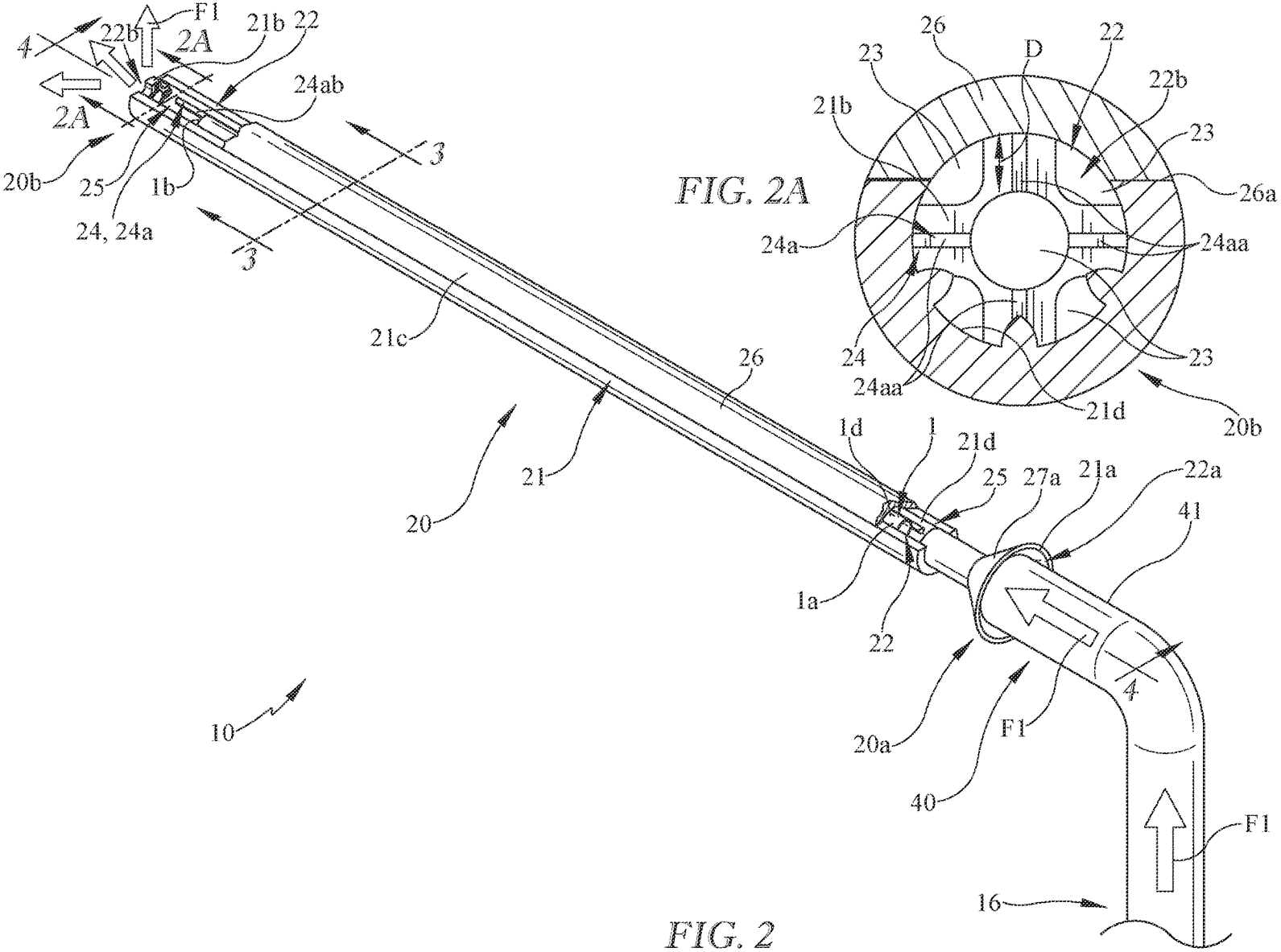
FIG. 2 is a perspective view of the embodiment of the carrier of FIG. 1 engaging the spray element when the rack is in the stowed position and illustrating a lid of the carrier in a closed position, with portions of the elongated body of the carrier broken away to show an embodiment of the straw positioned between the opposing ends of the carrier body.
FIG. 2*a* is a sectional view taken along line 2*a*-2*a* of FIG. 2.
Figure 3:
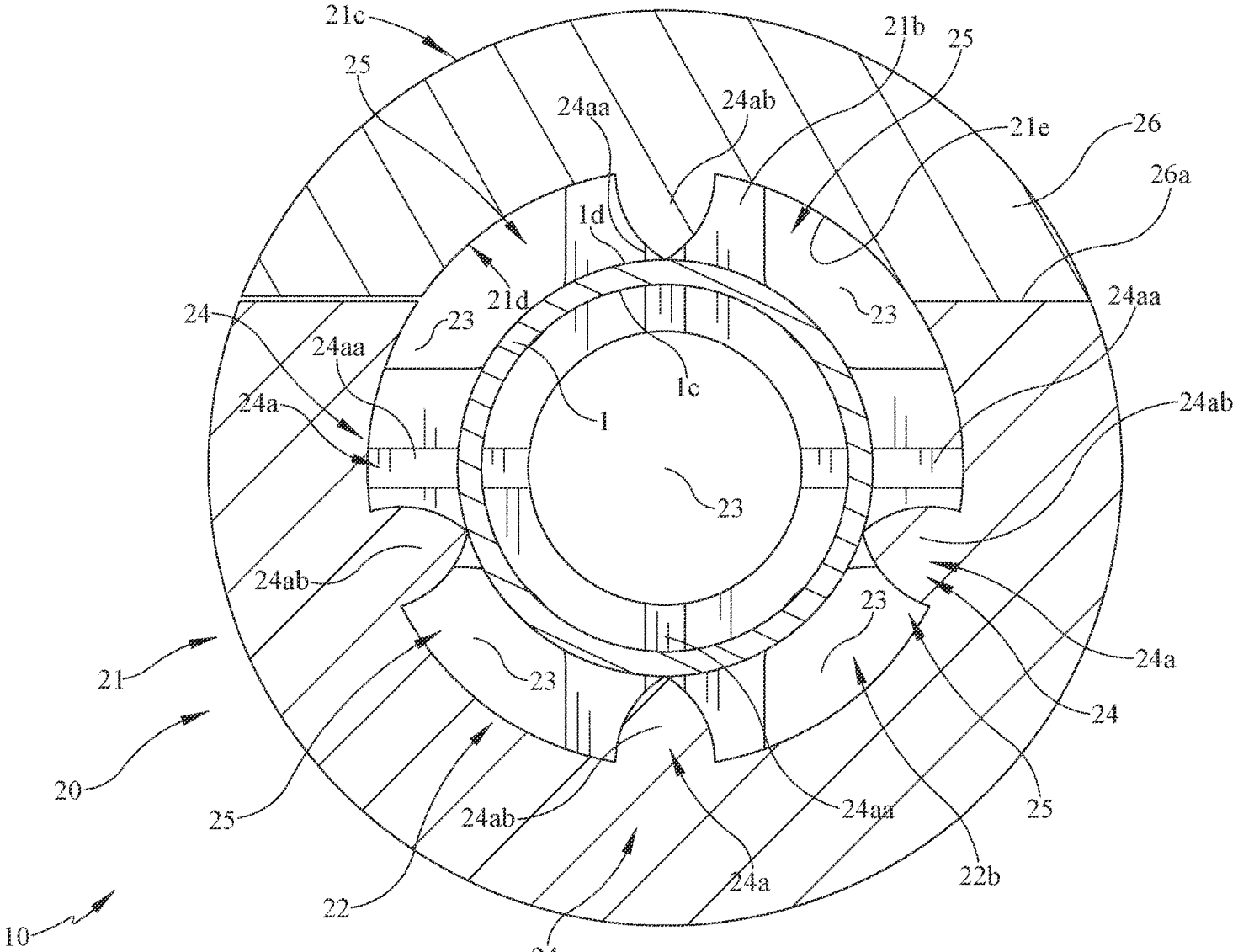
FIG. 3 is a sectional view taken along line 3-3 of FIG. 2.
Figure 4:
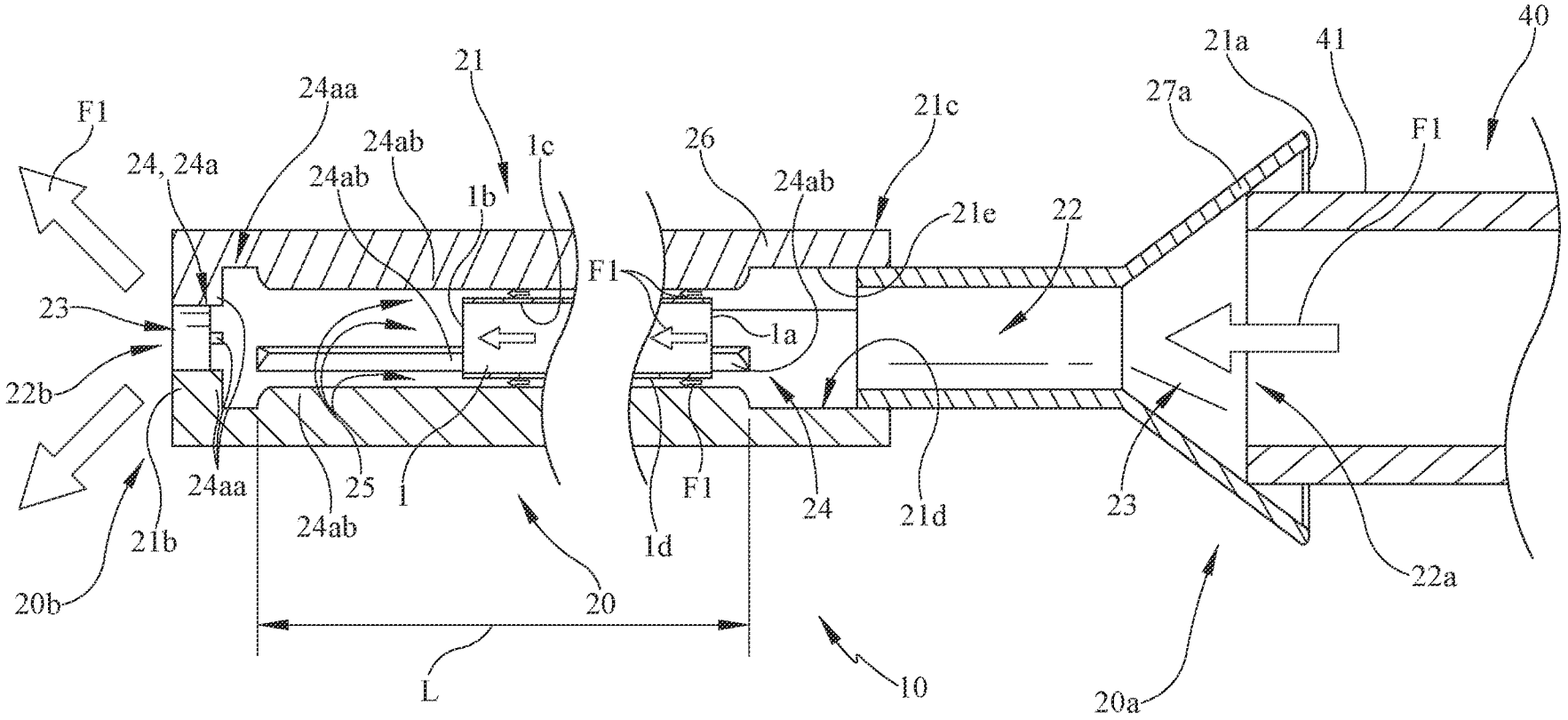
FIG. 4 is a sectional view taken along line 4-4 of FIG. 2.

As shown in FIGS. 2-3, the axial protrusions 24*aa*, if used, may be elongated and extend along one or more radii of the one or more end walls 21*a*, 21*b* of the interior 21*d* of the carrier 20, 120, 220, 320 to engage/position/space the first end 1*a* and/or second end 1*b* of the straw outer periphery from the remaining portion of the end wall(s). The axial protrusions 24*aa* may extend for a distance D in the radial direction or along a radius to engage across the first end 1*a* and/or second end 1*b*, or portions thereof (e.g. one or more cylindrical ends defining the straw opening). Although the axial protrusions 24*aa* are shown as being in an annular pattern or annular spaced about the straw diameter/axis and/or interior, the axial protrusions 24*aa* may extend across the entire diameter of the straw in some embodiments. Although the carrier 220 does not include the offsets 24 (e.g. axial and/or radial), it should be understood that the carrier may include one or more offsets (e.g. axial and/or radial) in some embodiments. Further, although the carriers 20 and 120 do not have offsets 24 (e.g. axial protrusions) adjacent the first end 20*a* (e.g. first end wall), it should be understood that axial protrusions may be used on the first end wall 21*a* and/or first end 20*a*. It should be understood that the protrusions (e.g. axial, radial) may be of a variety of shapes, sizes, quantities, orientations, positions, and constructions and still be within the scope of the invention. For example, the elongated protrusions (e.g. radial) may be in a nonlinear, spiral, or curve pattern about the longitudinal axis of the carrier/channel/straw in some embodiments rather than straight/axial in length as shown. Moreover, in some embodiments, the one or more protrusions may be curved, bumps, or domes in shape projecting from the one or more walls of the interior. Further, a plurality of protrusions may be aligned/patterned to form or define an elongated protrusion or offset extending for one or more lengths/circumferences.

In some implementations, the carrier 20, 120, 220, 320 and/or dish washing appliance 10 may include one or more lids 26. The lid 26 may be positionable between a closed position (see FIGS. 1-4 and 8) and an open position (see FIGS. 5 and 6). In the open position, one or more straws 1 may be inserted and/or removed from the carrier/rack/appliance. In the closed position, the one or more outlets 22*b* of the body are in fluid communication with the one or more inlets 22*a* and/or the channel 22 is operational to receive fluid (e.g. F1) and force fluid around (e.g. interior and/or exterior) the one or more straws 1. The lid 26, if used, may include one or more hinges 26*a* (e.g. living hinge) between the remaining portion(s) of the carrier. The lid 26 may be used for a single channel/straw as shown in FIG. 5 or may be used for access to a plurality of straws or channels as shown in FIG. 6. In some embodiments, a lid may not be used to close the channel and/or body. For example, as shown in the one embodiment in FIG. 7, the carrier 220 may include a catch or latch 226 to hold the straw(s) in position within the carrier/channel. The latch may cover a portion of one or more secondary openings when in the closed position as shown. The latch 226, if used, may be a single member hinged or clasped over a portion of a straw to secure the one or more straws during the wash cycle or washing of the straw(s). The latch may be an elastic band in some embodiments. It should be understood that the latch and/or lid may be a variety of shapes, sizes, quantities, and constructions and still be within the scope of the invention.

In some implementations, the carrier 20, 120, 320 may be described as having a substantially closed body. In some embodiments as shown in FIGS. 1-6 and 8, the closed body 21 of the carrier 20, 120, 320 may only include received fluid (e.g. F1) from the spray element (e.g. single) entering through the one or more inlets and exiting the one or more outlets. Being substantially closed may be defined by not having any additional apertures between the inlet and outlet of the carrier or no apertures within the internal wall (e.g. between the end walls). As shown in the one embodiment in FIGS. 1-6 and 8, the inlet 22*a* is defined by the first end wall 21*a* opposite the outlet 22*b* defined by the other or second end wall 21*b*. A first or single spray element 40 (e.g. 41) may be used to force fluid into the inlet(s) to wash both the inner and outer peripheries of the straw(s) of the closed body without the need of additional spray elements. The received fluid enters and exits from the closed body, end to end, similar to a nozzle to force fluid past the surfaces of the straw. Alternatively, in some implementations as shown in FIG. 7, the body 21 may be described as having a substantially open body. The open body 21 may use a plurality of spray elements 40 to wash the straw(s), or portions thereof. The open body 21 of the carrier 220 may include one or more additional or secondary openings 223 within the elongated body 21 (e.g. internal wall 21*e*) between the first end 20*a* or inlet 22*a* and the second end 20*b* or outlet 22*b*. The secondary openings 223, if used, may receive a second fluid F2 from a first spray element 40 (e.g. spray arms 42) to wash the exterior periphery 1*d* of the straw(s) 1 while a second spray element 40 (e.g. docking station 41) may at least wash the inner periphery of the straw(s) with the first fluid F1. The pin jet sprayer 27*b*, if used, of the carrier 220 may force the first fluid F1 through the interior periphery 1*c* and/or end 1*a* of the straw and/or exterior periphery 1*d*. The pin jet sprayer 27*b* may be one or more nozzles to provide one or more spray patterns and/or flow rates.

Figure 8:
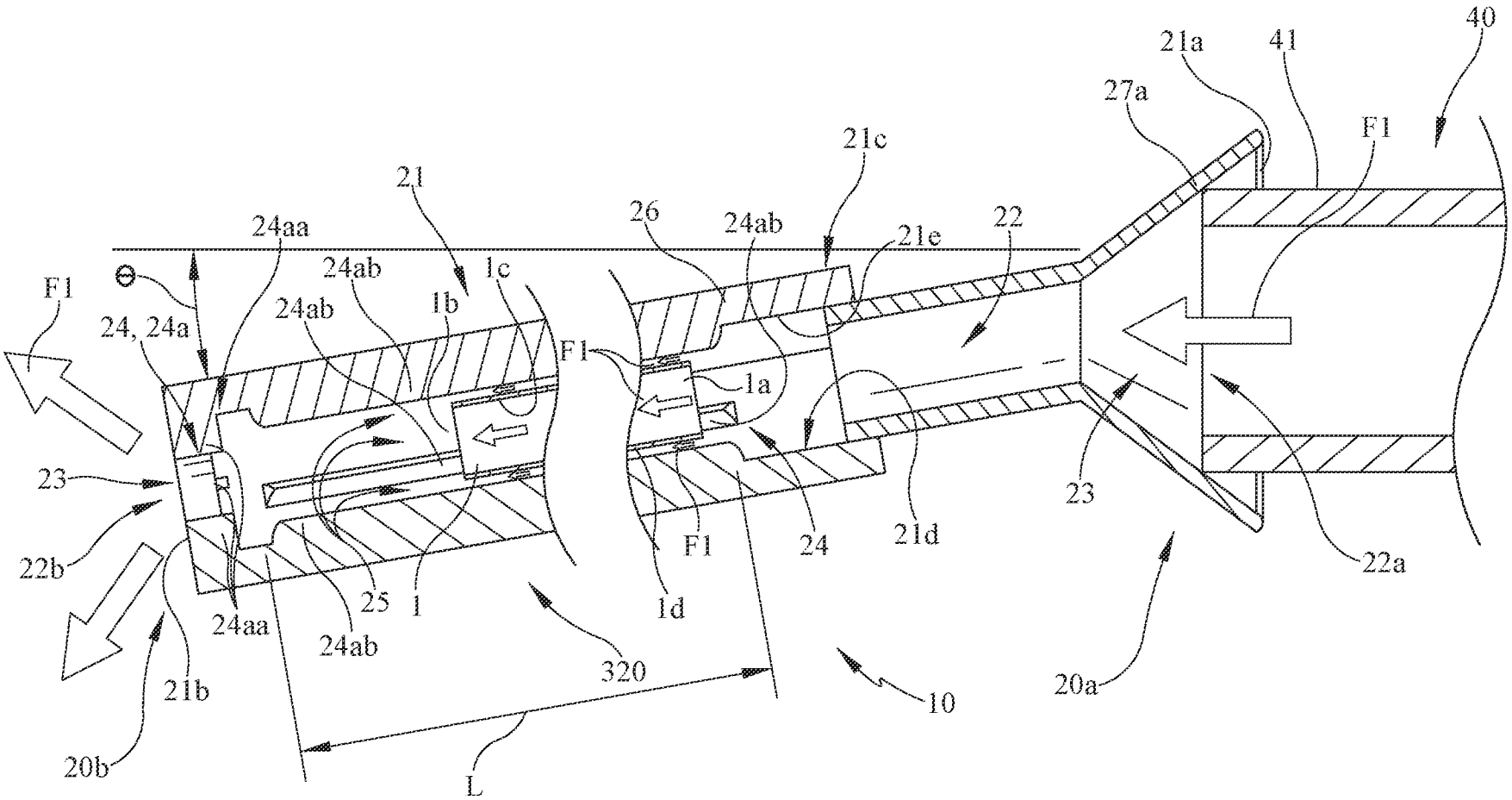
FIG. 8 is a side sectional view of another embodiment of a carrier illustrating an angled orientation within the rack.

In some implementations, a carrier 120 and/or dish washing appliance 10 may receive a plurality of straws 1. In the one embodiment shown in FIG. 6, the carrier 120 may include a plurality of channels 22 that each may receive at least one straw and/or a portion of the received fluid (e.g. F1). The lid 26, if used, may define a plurality of channels 22 and/or interiors 21*d* of the carrier. It should be understood that the lid may define at least one channel of a plurality of channels in some embodiments. The inlet 22*a* of the carrier 120 may be in fluid communication with the channels 22 and the respective outlets 22*b* thereof. The carrier 120 may include a divider or split 120*c*, if used, routing the received fluid from the inlet 22*a* and/or spray collector 27*a* to the plurality of channels 22 therein. The divider 120*c*, if used, may be positioned downstream of the spray collector 27*a*, if used. The divider 120*c* may distribute an upstream flow (e.g. single) of received fluid into multiple fluid pathways 25 towards the corresponding plurality of channels 22 each containing at least one straw, respectively. It should be understood that all the channels 22 do not need a corresponding straw therein. Although the carrier 20, 120, 320 of FIGS. 1, 6, and 8 is a closed body, it should be understood that the body may be open in some embodiments.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising:

a dishwasher tub;

a spray element disposed in the dishwasher tub, wherein the spray element includes one or more apertures, and the spray element is in fluid communication with a fluid supply to direct fluid from the fluid supply into the dishwasher tub through the one or more apertures;

a carrier having an elongated body, wherein the elongated body includes a first end having one or more inlets and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of the at least one straw through the opposing ends and exterior of the at least one straw from the opposing ends of the at least one straw that is positioned between the first end and the second end of the carrier; and wherein the elongated body of the carrier includes an interior, wherein the interior includes a first end wall and a second end wall interconnected by an internal wall.

2. The dish washing appliance of claim 1 wherein the carrier includes a channel, and wherein the channel of the carrier is orientated in a horizontal position.

3. The dish washing appliance of claim 1 wherein the carrier includes a channel, and wherein the channel of the carrier is orientated in an angled position.

4. The dish washing appliance of claim 3 wherein the one or more outlets is at a lower elevation than the one or more inlets.

5. The dish washing appliance of claim 1 wherein the carrier is positioned within a rack and the spray element is one or more docking stations positioned in a rear wall of the dishwasher tub, and wherein the one or more outlets of the carrier is in downstream fluid communication with the one or more docking stations when the rack is in a stowed position.

6. The dish washing appliance of claim 1 further comprising one or more protrusions projecting from at least one of the internal wall, the first end wall, and the second end wall to position an outer periphery of the at least one straw from a remaining portion of the interior of the elongated body not containing the one or more protrusions.

7. The dish washing appliance of claim 6 wherein the one or more protrusions project in an annular pattern about a cylindrical surface of the internal wall.

8. The dish washing appliance of claim 7 wherein the one or more protrusions are elongated along one or more lengths of the elongated body of the carrier.

9. The dish washing appliance of claim 6 wherein the one or more protrusions project axially inward from the at least one of the first end wall and the second end wall of the interior.

10. The dish washing appliance of claim 9 wherein the one or more protrusions are elongated along a radius of the at least one of the first end wall and the second end wall of the interior.

11. The dish washing appliance of claim 1 wherein the carrier includes a closed body wherein there is only fluid communication between the one or more inlets of the first end and the one or more outlets of the second end.

12. The dish washing appliance of claim 1 wherein the carrier includes an open body, wherein the elongated body includes one or more secondary openings within the elongated body between the first end and the second end.

13. The dish washing appliance of claim 1 wherein the elongated body includes a lid positionable between a closed position and an open position, wherein in the open position the at least one straw may be inserted and/or removed and in the closed position the one or more outlets of the elongated body are in fluid communication with the one or more inlets of the elongated body.

14. The dish washing appliance of claim 1 wherein the first end of the elongated body of the carrier includes a spray collector receiving the fluid from the spray element.

15. A dish washing appliance comprising:

a dishwasher tub having an opening defined by at least a rear wall opposite the opening;

a spray element disposed adjacent the rear wall of the dishwasher tub, wherein the spray element includes one or more apertures, and the spray element in fluid communication with a fluid supply to direct fluid from the fluid supply into the dishwasher tub through the one or more apertures;

a rack positionable between a stowed position and a deployed position different from the stowed position; and a carrier having an elongated body supported in the rack, wherein the elongated body includes a first end having one or more inlets adjacent to and in fluid communication with the spray element when the rack is in the stowed position and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of the at least one straw through the opposing ends and exterior of the at least one straw from the opposing ends of the at least one straw that is positioned between the first end and the second end of the carrier.

16. The dish washing appliance of claim 15 wherein an interior of the elongated body includes at least one of an axial protrusion and a radial protrusion projecting inwardly from the interior towards the at least one straw.

17. The dish washing appliance of claim 15 wherein the carrier is a closed body wherein there is only fluid communication between the one or more inlets of the first end and the one or more outlets of the second end.

18. The dish washing appliance of claim 15 wherein the carrier includes an open body, wherein the elongated body includes one or more secondary openings within the elongated body between the first end and the second end.

19. The dish washing appliance of claim 15 wherein the first end of the carrier includes a divider routing the received fluid to a plurality of channels defined by the elongated body of the carrier.

20. The dish washing appliance of claim 15 wherein the spray element is a docking station adjacent the rear wall, and the first end of the carrier fluidly engages the docking station when the rack is in the stowed position.

21. The dish washing appliance of claim 15 wherein the elongated body includes a lid positionable between a closed position and an open position, wherein in the open position the at least one straw may be inserted and/or removed and in the closed position the one or more outlets of the elongated body are in fluid communication with the one or more inlets of the elongated body.

22. The dish washing appliance of claim 15 wherein the carrier includes one or more pin jet sprayers.

23. The dish washing appliance of claim 15 wherein the elongated body includes a latch positionable between a closed position and an open position, wherein in the open position the at least one straw may be inserted and/or removed and in the closed position the at least one straw is secured.

24. The dish washing appliance of claim 15 wherein the carrier includes a channel, and wherein the channel of the carrier is orientated in an angled position.

25. A dish washing appliance comprising:

a dishwasher tub;

a spray element disposed in the dishwasher tub, wherein the spray element includes one or more apertures, and the spray element is in fluid communication with a fluid supply to direct fluid from the fluid supply into the dishwasher tub through the one or more apertures;

a carrier having an elongated body, wherein the elongated body includes a first end having one or more inlets and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of the at least one straw through the opposing ends and exterior of the at least one straw from the opposing ends of the at least one straw that is positioned between the first end and the second end of the carrier; and wherein the carrier includes a closed body wherein there is only fluid communication between the one or more inlets of the first end and the one or more outlets of the second end.

26. A dish washing appliance comprising:

a dishwasher tub;

a spray element disposed in the dishwasher tub, wherein the spray element includes one or more apertures, and the spray element is in fluid communication with a fluid supply to direct fluid from the fluid supply into the dishwasher tub through the one or more apertures;

a carrier having an elongated body, wherein the elongated body includes a first end having one or more inlets and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of the at least one straw through the opposing ends and exterior of the at least one straw from the opposing ends of the at least one straw that is positioned between the first end and the second end of the carrier; and wherein the elongated body includes a lid positionable between a closed position and an open position, wherein in the open position the at least one straw may be inserted and/or removed and in the closed position the one or more outlets of the elongated body are in fluid communication with the one or more inlets of the elongated body.

27. A dish washing appliance comprising:

a dishwasher tub;

a spray element disposed in the dishwasher tub, wherein the spray element includes one or more apertures, and the spray element is in fluid communication with a fluid supply to direct fluid from the fluid supply into the dishwasher tub through the one or more apertures;

a carrier having an elongated body, wherein the elongated body includes a first end having one or more inlets and a second end having one or more outlets, wherein opposing ends of at least one straw are positioned between the one or more inlets and the one or more outlets of the elongated body, the carrier configured to receive fluid from the spray element and route the received fluid out of the one or more outlets to wash an interior of the at least one straw through the opposing ends and exterior of the at least one straw from the opposing ends of the at least one straw that is positioned between the first end and the second end of the carrier; and wherein the first end of the elongated body of the carrier includes a spray collector receiving the fluid from the spray element.

* * * * *